US005884418A

United States Patent [19]

McNally

[11] Patent Number: 5,884,418

[45] Date of Patent: Mar. 23, 1999

[54] PROCESS AND SYSTEM FOR IMPREGNATING GARMENTS WITH INSECT REPELLENT

[75] Inventor: Bartley F. McNally, North Providence, R.I.

[73] Assignee: The United States of America as represented by the Secretary of the Army, Washington, D.C.

[21] Appl. No.: 92,818

[22] Filed: Jun. 8, 1998

[51] Int. Cl.[6] ..... F26B 19/00

[52] U.S. Cl. ..... 34/389; 34/426; 34/499

[58] Field of Search ..... 34/339, 381, 389, 34/426, 499, 60, 61, 90, 597; 8/150, 158; 68/58, 143, 148; 424/403, 404, 405, 409; 427/240, 242

[56] References Cited

U.S. PATENT DOCUMENTS

| | | | |
|---|---|---|---|
| 3,401,052 | 9/1968 | Berger et al. | 117/105.4 |
| 5,082,468 | 1/1992 | Hopkins | 8/477 |
| 5,089,298 | 2/1992 | McNally et al. | 427/240 |
| 5,154,947 | 10/1992 | Branch et al. | 427/242 |
| 5,187,955 | 2/1993 | Hertig et al. | 68/58 |
| 5,461,742 | 10/1995 | Pasad et al. | 8/149.2 |
| 5,631,072 | 5/1997 | Samson et al. | 442/125 |

*Primary Examiner*—Henry Bennett
*Assistant Examiner*—Steve Gravini
*Attorney, Agent, or Firm*—Vincent J. Ranucci

[57] ABSTRACT

A process and system for impregnating garments with insect repellent, the process including the steps of placing the garments in a first machine and tumbling the garments therein, introducing into the first machine a mixture of liquid insect repellent and water so as to spray the mixture onto the tumbling garments, terminating the introduction of the mixture into the first machine and continuing the tumbling of the garments therein, terminating the tumbling of the garments in the first machine, and placing the garments in a second machine and tumble drying the garments therein; and the system comprising a reservoir for a mixture of the repellent in liquid form and water, a first machine for receiving and retaining the garments and tumbling the garments, a spray nozzle in the first machine for directing a spray of the mixture onto the garments during tumbling thereof, a conduit extending from the reservoir to the spray nozzle, and a pump in the conduit for flowing the mixture from the reservoir to the spray nozzle, and a second machine for receiving and retaining the sprayed garments, when removed from the first machine, for tumble drying the garments.

8 Claims, 1 Drawing Sheet

PROCESS AND SYSTEM FOR IMPREGNATING GARMENTS WITH INSECT REPELLENT

STATEMENT OF GOVERNMENT INTEREST

The invention described herein may be manufactured and used by or for the Government of the United States of America for governmental purposes without the payment of royalties thereon or therefor.

BACKGROUND OF THE INVENTION

1. Field of the Invention

The invention relates to impregnation of garments with substances, and is directed more particularly to the impregnation of garments with insect repellent in an enclosed readily available device.

2. Description of the Prior Art

It is known to apply insect repellents to garments. For example, the U.S. Army has applied Permethrin, a synthetic pyrethroid, to military battle dress uniforms (BDUs). Permethrin is known for its insect/arthropod repellent qualities, and its relative safety in garments worn by humans.

BDU's have been saturated with a Permethrin-water mixture, hand squeezed, and hung to air dry. This method is essentially limited to individual garment treatment, and is unsafe environmentally and for the individual undertaking the application. Further, it is difficult to control the level of application.

BDUs have also been treated with Permethrin-water mixtures using a hand-held sprayer which contains the mixture at a selected Permethrin concentration and a constant pressure, and which discharges during a timed application period. This method is limited to individual garment treatment. It has further been found difficult to maintain the desired pressure level and application time period. Still further, this process carries attendant threats to the environment and the individual carrying out the process.

It is known to apply a Permethrin-water mixture in an enclosed device, such as a garment washing machine, finish application machine, or dye machine. In this method, the garments are totally immersed in the mixture. Accordingly, the Permethrin applied to the garments typically is well beyond the absorption capacity of the garments, leading to the uneconomical use of Permethrin. Further, attaining a uniform application and target level of Permethrin is very difficult and has not been demonstrated.

Thus, there is a need for a process for the application of Permethrin, and the like, to garments, wherein the process can be applied to multiple garments in a closed device, is safe for the environment and operators, and can be controlled so as to provide uniform application within desired limits.

SUMMARY OF THE INVENTION

An object of the invention is, therefore, to provide a process for impregnating garments with insect repellent.

A further object of the invention is to provide such a process as can be applied simultaneously to multiple garments.

A still further object of the invention is to provide such a process suitable for carrying out in enclosed devices, and which is environmentally safe and medically safe for the operator.

A still further object of the invention is to provide such a process wherein the levels of repellent application are controllable, such that selected ranges of impregnation can be accurately effected.

A still further object of the invention is to provide a system facilitating operation of the above process in an accurate, efficient, and environmentally safe manner.

With the above and other objects in view, as will hereinafter appear, a feature of the present invention is the provision of a process for impregnating garments with insect repellent. The process comprises the steps of placing the garments in a clothes washing and tumbler type first machine and tumbling the garments therein, introducing into the first machine a spray mixture of liquid insect repellent and water so as to spray the mixture onto the tumbling garments, terminating the introduction of the mixture into the first machine and continuing the tumbling of the garments therein, terminating the tumbling of the garments in the first machine and withdrawing the garments from the first machine, and placing the garments in a clothes dryer and tumbler type second machine and tumble drying the garments therein.

In accordance with a further feature of the invention, there is provided a system for impregnating garments with insect repellent that is accurate, efficient, and environmentally safe. The system comprises a reservoir for a mixture of the repellent in liquid form and water, a clothes washing and tumbler type first machine for receiving and retaining the garments and tumbling the garments, a spray nozzle in the first machine for directing a spray of the mixture onto the garments in the first machine during tumbling thereof, a conduit extending from the reservoir to the spray nozzle, and a pump in the conduit for flowing the mixture from the reservoir to the spray nozzle. The system further comprises a clothes dryer and tumbler type second machine for receiving and retaining the sprayed garments, when removed from the first machine, for tumble drying the garments.

The above and other features of the invention, including various novel details of combinations of steps and devices, will now be more particularly described with reference to the accompanying drawings and pointed out in the claims. It will be understood that the particular process and system embodying the invention are shown by way of illustration only and not as limitations of the invention. The principles and features of this invention may be employed in various and numerous embodiments without departing from the scope of the invention.

BRIEF DESCRIPTION OF THE DRAWINGS

Reference is made to the accompanying drawings in which are shown illustrative embodiments of the invention, from which its novel features and advantages will be apparent.

In the drawings.

DESCRIPTION OF THE PREFERRED EMBODIMENTS

Figure 1:
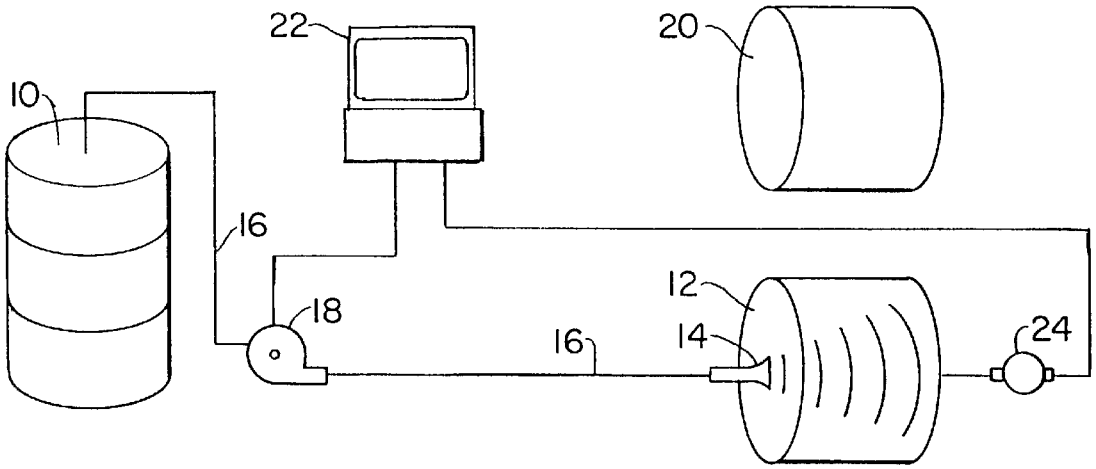
FIG. 1 is a diagrammatic view of one form of system illustrative of an embodiment of the invention.
Figure 2:
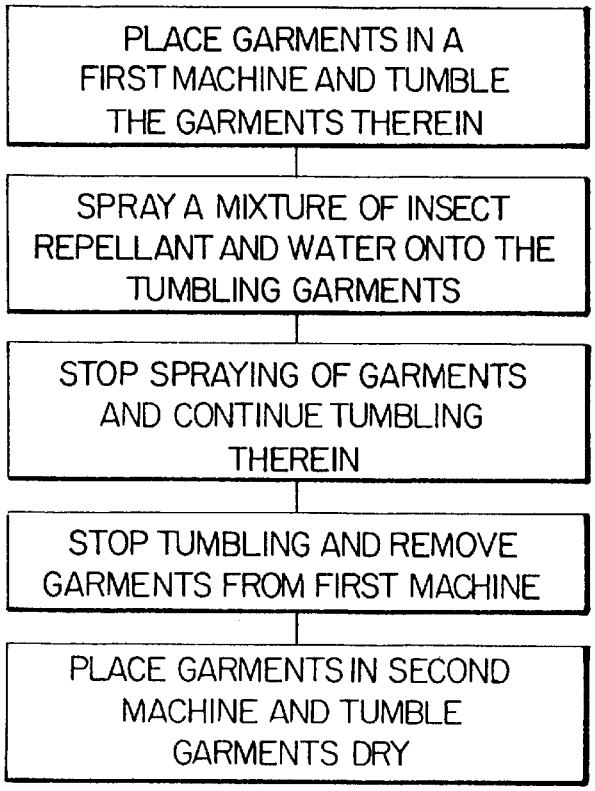
FIG. 2 is a block diagram of one form of process illustrative on an embodiment of the invention.

Referring to FIG. 1, it will be seen that an illustrative system includes a reservoir 10, which may be a can, or drum, or other such container, for retaining a mixture of liquid insect repellent and water. A clothes washer and tumbler type first machine 12 is provided for receiving and retaining garments (not shown) to be treated. The first machine 12 alternatively may be a garment finish application machine or a dye machine. Such machines are readily available on the market, particularly the clothes washing type.

In accordance with the invention, a spray nozzle 14 is disposed in the first machine 12 for directing a spray of the mixture from the reservoir 10 onto clothes tumbling in the first machine. A conduit 16 extends from the reservoir 10 to the spray nozzle 14. A pump 18 is disposed in the conduit 16 for flowing the mixture from the reservoir to the spray nozzle.

A clothes drier and tumble type second machine 20 is provided for receiving and retaining the sprayed garments when removed from the first machine 12, for tumble drying of the garments.

The system further includes a microprocessor 22 for controlling the speed of rotation, as well as rotation times, of the first machine 12, as by controlling the speed of a drive motor 24, and for controlling the flow rate of the mixture through the conduit 16, as by controlling the operation of the pump 18. Preferably, the reservoir 10 contains a mixture of Permethrin and water and the microprocessor 22 is operable to control the flow rate of the mixture through the conduit 16 so as to cause to be applied to the garments an amount of Permethrin equal to at least about 60% of the Permethrin absorption capacity, by weight, of the garments, or an amount of Permethrin sufficient to provide at least about 0.125 milligrams of Permethrin per square centimeter of garment surface area.

While the system and method described herein finds application with any liquid insect repellent, Permethrin is known for its insect/arthropod repellent qualities and for its relative safety when used by humans.

The above-described system is used to impregnate garments with insect repellent by placing the garments in the first machine 12 and tumbling the garments therein. A measured mixture of the liquid insect repellent, preferably the aforementioned Permethrin, and water are introduced into the first machine 12 through the spray nozzle 14 so as to spray the mixture onto the tumbling garments for a period of about ten minutes. Thereafter, the garments are tumbled in the first machine 12 for another ten minutes, or thereabouts.

The garments are then removed from the first machine, transferred to the second machine 20, and tumble-dried therein for about fifty-five minutes at a temperature of about 140°–143° F.

The aforementioned microprocessor 22 preferably is operated to control the speed of rotation and rotation times of the first machine 12, and the rate of flow of the repellent and water mixture into the first machine 12. As noted above, the microprocessor 22 preferably is operated to control the repellent mixture flow rates so as to apply to the garments an amount of repellent equal to at least about 60% of the repellent absorption capacity, by weight, of the garments, or an amount of repellent sufficient to provide at least about 0.125 milligrams of repellent per square centimeter of garment surface area.

There is thus provided a system and process for impregnating multiple garments simultaneously, with insect repellent, in enclosed devices, with no danger to the environment or to an operator. There is further provided such a system and process wherein the levels of repellent application are controllable, such that selected ranges of impregnation can be effected accurately.

It is to be understood that the present invention is by no means limited to the particular system and process herein disclosed and/or shown in the drawings, but also comprises any modifications or equivalents within the scope of the claims.

What is claimed is:

1. A process for impregnating garments with insect repellent, the process comprising the steps of:

placing the garments in a clothes washing and tumbler type first machine and tumbling the garments therein;

introducing into the first machine a mixture of liquid insect repellent and water so as to spray the mixture onto the tumbling garments;

terminating the introduction of the mixture into the first machine and continuing the tumbling of the garments therein;

terminating the tumbling of the garments in the first machine and withdrawing the garments from the first machine; and placing the garments in a clothes dryer type second machine and tumble drying the garments therein.

2. The process in accordance with claim 1 including the additional step of operating a microprocessor to control the first machine's speed of rotation and rotation times, and flow rate of the mixture.

3. The process in accordance with claim 2 wherein the repellent is Permethrin.

4. The process in accordance with claim 3 wherein the microprocessor controls the flow rate of the mixture so as to apply to the garments an amount of the Permethrin equal to about 60% of the Permethrin absorption capacity, by weight, of the garments.

5. The process in accordance with claim 3 wherein the microprocessor controls the flow rate of the mixture so as to apply to the garments an amount of the Permethrin sufficient to provide about 0.125 mg of Permethrin per square centimeter of garment surface area.

6. The process in accordance with claim 3 wherein said mixture is sprayed onto the garments in said first machine for about ten minutes.

7. The process in accordance with claim 6 wherein after the termination of the introduction of the mixture into the first machine, the step of continuing the tumbling of the garments therein is conducted for about ten minutes.

8. The process in accordance with claim 7 wherein the tumble drying of the garments in the second machine is conducted for about fifty-five minutes at a temperature of about 140°–143° F.

* * * * *